US010582600B2

(12) United States Patent
Kamikanna et al.

(10) Patent No.: US 10,582,600 B2
(45) Date of Patent: Mar. 3, 2020

(54) DROPLET COLLECTION DEVICE

(71) Applicant: Gigaphoton Inc., Tochigi (JP)

(72) Inventors: Kazukiyo Kamikanna, Oyama (JP); Fumio Iwamoto, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 16/244,492

(22) Filed: Jan. 10, 2019

(65) Prior Publication Data

US 2019/0150261 A1 May 16, 2019

Related U.S. Application Data

(63) Continuation of application No. PCT/JP2016/075529, filed on Aug. 31, 2016.

(51) Int. Cl.
*H05G 2/00* (2006.01)

(52) U.S. Cl.
CPC ..... *H05G 2/003* (2013.01); *H05G 2/005* (2013.01); *H05G 2/008* (2013.01)

(58) Field of Classification Search
CPC ..... H05G 2/003; H05G 2/00; H05G 2/008; H05G 2/005; G03F 7/70033
See application file for complete search history.

(56) References Cited

U.S. PATENT DOCUMENTS 9,854,658 B2 * 12/2017 Iwamoto ..... H05G 2/005
10,028,366 B2 * 7/2018 Hori ..... H05G 2/005
2010/0258748 A1 * 10/2010 Vaschenko ..... H05G 2/003 250/504 R
2012/0248343 A1 * 10/2012 Nagai ..... H05G 2/003 250/504 R
2016/0192470 A1 6/2016 Iwamoto et al.
2016/0208414 A1 7/2016 Odawara et al.
2016/0255709 A1 9/2016 Iwamoto et al.
2017/0332467 A1 * 11/2017 Sanders ..... H05G 2/005
(Continued)

FOREIGN PATENT DOCUMENTS

JP S56-17914 A 2/1981
JP S59-217994 A 12/1984
(Continued)

OTHER PUBLICATIONS

International Search Report issued in PCT/JP2016/075529; dated Nov. 22, 2016.
(Continued)

*Primary Examiner* — Brooke Purinton
(74) *Attorney, Agent, or Firm* — Studebaker & Brackett PC

(57) ABSTRACT

A droplet collection device may include a collecting container, a collision plate arranged in the collecting container and configured such that a droplet supplied from the opening to the collecting container is to collide with the collision plate, and a buffer member arranged on an opening side with respect to the collision plate and configured to mitigate impact of the droplet colliding with the collision plate. The buffer member may have a wire rod bundle configured such that multiple wire rods are bundled and fixed to a plate member. The wire rods may be made of carbon, and the plate member may be made of graphite. The wire rods may be fixed to the plate member with a graphitized adhesive with the wire rods being arranged in one direction.

4 Claims, 10 Drawing Sheets

(56) References Cited

U.S. PATENT DOCUMENTS

| | | | | |
|---|---|---|---|---|
| 2017/0349999 | A1* | 12/2017 | Burton | C23C 14/243 |
| 2019/0150264 | A1* | 5/2019 | Kamikanna | H05G 2/00 |

FOREIGN PATENT DOCUMENTS

| | | | |
|---|---|---|---|
| JP | 2012-523666 | A | 10/2012 |
| JP | 2015-050436 | A | 3/2015 |
| WO | 2010117858 | A1 | 10/2010 |
| WO | 2015063825 | A1 | 5/2015 |
| WO | 2015097888 | A1 | 7/2015 |

OTHER PUBLICATIONS

Written Opinion issued in PCT/JP2016/075529; dated Nov. 22, 2016.

* cited by examiner

DROPLET COLLECTION DEVICE

CROSS-REFERENCE TO RELATED APPLICATIONS

The present application is a continuation application of International Application No. PCT/JP2016/075529 filed on Aug. 31, 2016. The content of the application is incorporated herein by reference in its entirety.

BACKGROUND

1. Technical Field

The present invention relates to a droplet collection device.

2. Related Art

In recent years, along with miniaturization of a semiconductor process, miniaturization of a transfer pattern in photolithography of a semiconductor process has been developed rapidly. In the next generation, fine processing of equal to or less than 20 nm will be demanded. It is expected to develop an exposure device in which a device configured to generate extreme ultraviolet (EUV) light having a wavelength of about 13 nm and reduced projection reflective optics are combined.

As an extreme ultraviolet light generation system, three types of devices have been proposed, namely a laser produced plasma (LPP) type device using plasma generated by irradiation of a target substance with laser light, a discharge produced plasma (DPP) type device using plasma generated by electric discharge, and a synchrotron radiation (SR) type device using orbital radiation light.

[Patent Literature 1] JP S56-17914 A
[Patent Literature 2] JP S59-217994 A
[Patent Literature 3] JP 2015-50436 A
[Patent Literature 4] WO 2015/097888 A

SUMMARY

A droplet collection device according to one aspect of the present disclosure may include a collecting container, a collision plate, and a buffer member. The collecting container may be arranged on an outer wall surface side of a wall of a chamber and configured to communicate with the inside of the chamber through an opening provided at the wall of the chamber. The collision plate may be arranged in the collecting container and configured such that a droplet supplied from the opening to the collecting container is to collide with the collision plate. The buffer member may be arranged on an opening side with respect to the collision plate and configured to mitigate impact of the droplet colliding with the collision plate. The buffer member may have a wire rod bundle configured such that multiple wire rods are bundled and fixed to a plate member. The wire rods may be made of carbon, and the plate member may be made of graphite. The wire rods may be fixed to the plate member with a graphitized adhesive with the wire rods being arranged in one direction.

BRIEF DESCRIPTION OF THE DRAWINGS

Some embodiments of the present disclosure will be described below as mere examples with reference to the accompanying drawings.

DETAILED DESCRIPTION

Figure 1:
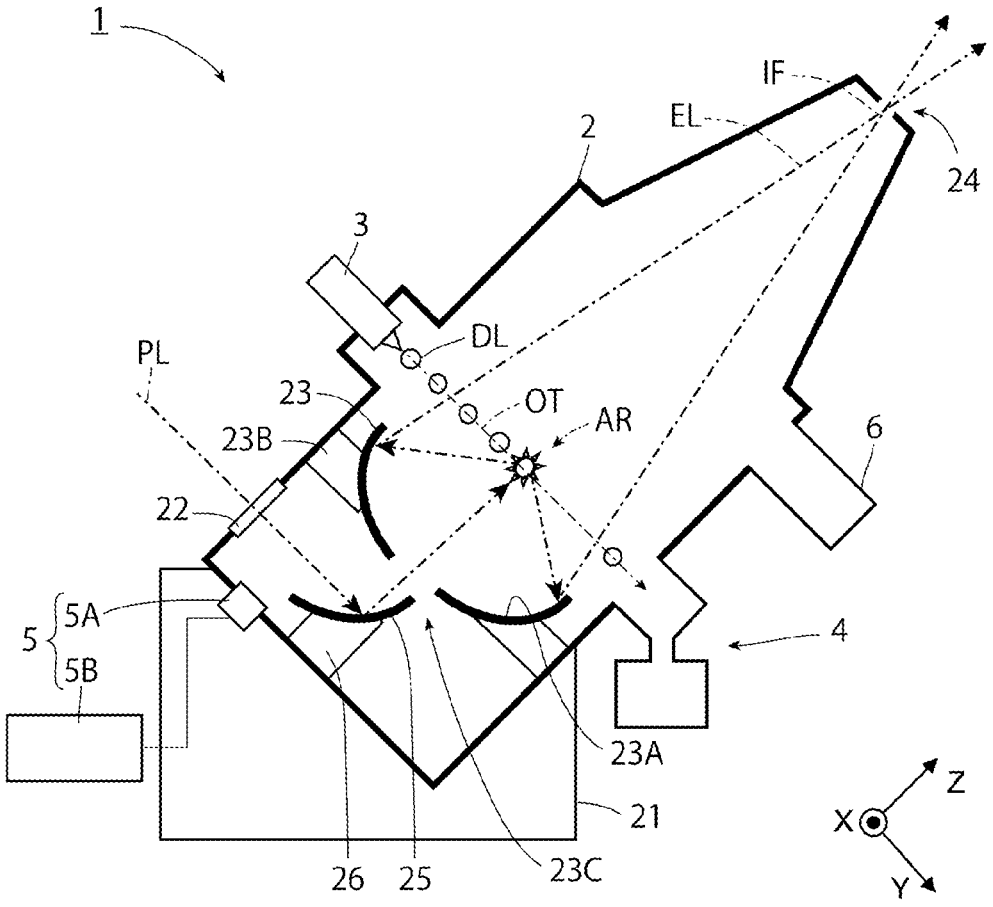
FIG. 1 is a schematic view of an outline configuration example of an entire extreme ultraviolet light generation system.

1. Overview
2. Description of extreme ultraviolet light generation system
   2.1 Overall configuration
   2.2 Operation
3. Comparative example
   3.1 Configuration of droplet collection device
   3.2 Operation
   3.3 Disadvantage
4. First embodiment
   4.1 Partial configuration in droplet collection device
   4.2 Feature/advantageous effect
5. Second embodiment
   5.1 Partial configuration in droplet collection device
   5.2 Feature/advantageous effect
6. Third embodiment
   6.1 Partial configuration in droplet collection device
   6.2 Feature/advantageous effect
7. Fourth embodiment
   7.1 Partial configuration in droplet collection device
   7.2 Feature/advantageous effect
8. Fifth embodiment
   8.1 Partial configuration in droplet collection device
   8.2 Feature/advantageous effect
9. Sixth embodiment
   9.1 Partial configuration in droplet collection device
   9.2 Feature/advantageous effect
10. Seventh embodiment
   10.1 Partial configuration in droplet collection device
   10.2 Feature/advantageous effect Hereinafter, embodiments of the present disclosure will be described in detail with reference to the drawings.

The embodiments described below illustrate some examples of the present disclosure, and do not limit the contents of the present disclosure. All of configurations and operations described in each embodiment are not always indispensable as configurations and operations of the present disclosure.

Note that the same components are denoted by the same reference signs, and overlapping description is omitted.

1. Overview

Each embodiment of the present disclosure relates to an extreme ultraviolet light generation system configured to generate light with a wavelength called extreme ultraviolet (EUV). Note that in the present specification, the extreme ultraviolet light will be hereinafter sometimes referred to as "EUV light".

2. Description of Extreme Ultraviolet Light Generation System

2.1 Overall Configuration

As illustrated in FIG. 1, an extreme ultraviolet light generation system 1 of the present embodiment includes a chamber 2, a droplet supply device 3, a droplet collection device 4, an etching gas supply device 5, and an exhaust device 6.

The chamber 2 is a container which can be sealed and depressurized, and is held by a chamber holder 21. A wall of the chamber 2 has at least one through-hole, and the through-hole is closed by a window 22. The window 22 allows transmission of pulse laser light PL emitted from a laser device (not shown) arranged outside the chamber 2.

In the chamber 2, a predetermined region including part of a trajectory OT of a droplet DL supplied into the chamber 2 is a plasma generation region AR where the droplet DL is converted into plasma.

Moreover, in the chamber 2, a light focusing mirror 23 having a rotary oval reflection surface 23A is held, for example, by a mirror holder 23B fixed to the wall of the chamber 2. The light focusing mirror 23 is configured to reflect EUV light EL, contained in light generated due to conversion of the droplet DL into the plasma in the plasma generation region AR on the reflection surface 23A to focus light, on a focal point, thereby emitting the resultant light to an exposure device (not shown) through an output port 24 of the chamber 2. The focal point of the light focusing mirror 23 may include a first focal point and a second focal point. For example, the first focal point is positioned in the plasma generation region AR, and the second focal point is positioned at an intermediate focal point IF as a light focusing position defined according to, e.g., specifications of the exposure device (not shown). Note that at the light focusing mirror 23 may have a through-hole 23C through which the pulse laser light PL propagating from the window 22 into the chamber 2 passes.

Moreover, in the chamber 2, a laser light focusing optical system 25 configured to focus, on the plasma generation region AR, the pulse laser light PL propagating from the window 22 into the chamber 2 is provided. For example, the laser light focusing optical system 25 is fixed to a plate 26 arranged on the opposite side of the light focusing mirror 23 from the reflection surface 23A, and focuses the pulse laser light PL, which has propagated from the window 22 into the chamber 2, on the plasma generation region AR through the through-hole 23C of the light focusing mirror 23. Note that the plate 26 may be configured movable in three axis directions, and the plate 26 may be moved such that a light focusing position in the plasma generation region AR by the laser light focusing optical system 25 is changed.

The droplet supply device 3 is a device configured to supply, as the droplet DL, a target substance as a substance targeted for conversion into the plasma in the plasma generation region AR into the chamber 2, and for example, is attached to penetrate the wall of the chamber 2. A material of the target substance supplied from the droplet supply device 3 may include, but not limited to, any of tin, terbium, gadolinium, lithium, and xenon or a combination of any two or more of these materials.

The droplet collection device 4 is a device configured to collect droplets DL not converted into the plasma in the plasma generation region AR among droplets DL supplied into the chamber 2. For example, the droplet collection device 4 is provided on the outside of the chamber 2 on a side opposite to the wall of the chamber 2 to which the droplet supply device 3 is attached.

The etching gas supply device 5 is a device configured to supply, into the chamber 2, gas to be reacted with debris and ion generated by conversion of the droplet DL into the plasma. For example, the etching gas supply device 5 may include a gas generation unit 5B and a gas introduction unit 5A configured to introduce gas generated in the gas generation unit 5B into the chamber 2. In a case where the material of the droplet DL as the target substance is tin, gas supplied from the etching gas supply device 5 is, e.g., hydrogen gas or gas containing hydrogen. In this case, fine tin particles and tin ion generated by conversion of the droplet DL into the plasma react with hydrogen, and are converted into stannane gas at room temperature.

The exhaust device 6 is a device configured to discharge residual gas from the chamber 2. The residual gas discharged by the exhaust device 6 contains the debris and the ion, a product generated by reaction of the debris and the ion with etching gas, and unreacted etching gas. Note that the exhaust device 6 may discharge the same amount of residual gas as the amount of etching gas supplied from the etching gas supply device 5 into the chamber 2, and may maintain the internal pressure of the chamber 2 substantially constant.

2.2 Operation

The pulse laser light PL emitted from the laser device (not shown) propagates to the laser light focusing optical system 25 in the chamber 2 through the window 22, and is focused on the plasma generation region AR by the laser light focusing optical system 25. Moreover, the droplet DL supplied from the droplet supply device 3 into the chamber 2 passes through the plasma generation region AR including part of the trajectory OT of the droplet DL.

Some of the droplets DL passing through the plasma generation region AR are irradiated with the pulse laser light PL focused by the laser light focusing optical system 25, and the other droplets DL are not irradiated with the pulse laser light PL, but are collected by the droplet collection device 4.

The droplet DL irradiated with the pulse laser light PL is converted into the plasma, and the light including the EUV light EL is emitted from the plasma. The EUV light EL is selectively reflected on the reflection surface 23A of the light focusing mirror 23, and then, is emitted to the exposure device (not shown) outside the chamber 2.

In a case where the droplet DL is converted into the plasma, the light including the EUV light EL is emitted, and the debris and the ion are diffused. Part of the debris and the ion react with the etching gas supplied from the etching gas supply device 5 into the chamber 2, and therefore, are converted into gas. Thus, sputtering due to debris accumulation on the window 22 or the reflection surface 23A of the light focusing mirror 23 and ion collision with the window 22 or the reflection surface 23A of the light focusing mirror 23 is reduced.

The etching gas, the gas resulting from a change due to reaction with the etching gas, and the debris and the ion unreacted with the etching gas are discharged by the exhaust device 6. This suppresses these substances from remaining in the chamber 2.

Note that after the droplet DL reaching the plasma generation region AR has been irradiated with prepulse laser light and the target substance has been diffused, such a diffused target substance might be irradiated with main pulse laser light, and might be converted into the plasma. In this case, a conversion efficiency (CE) from energy of the laser light into energy of the EUV light EL can be improved.

3. Comparative Example

3.1 Configuration of Droplet Collection Device

Next, a configuration of a droplet collection device as a comparative example of the following embodiments will be described. Note that the same reference signs are used to represent configurations similar to those described above, and unless otherwise described, overlapping description is omitted.

Figure 2:
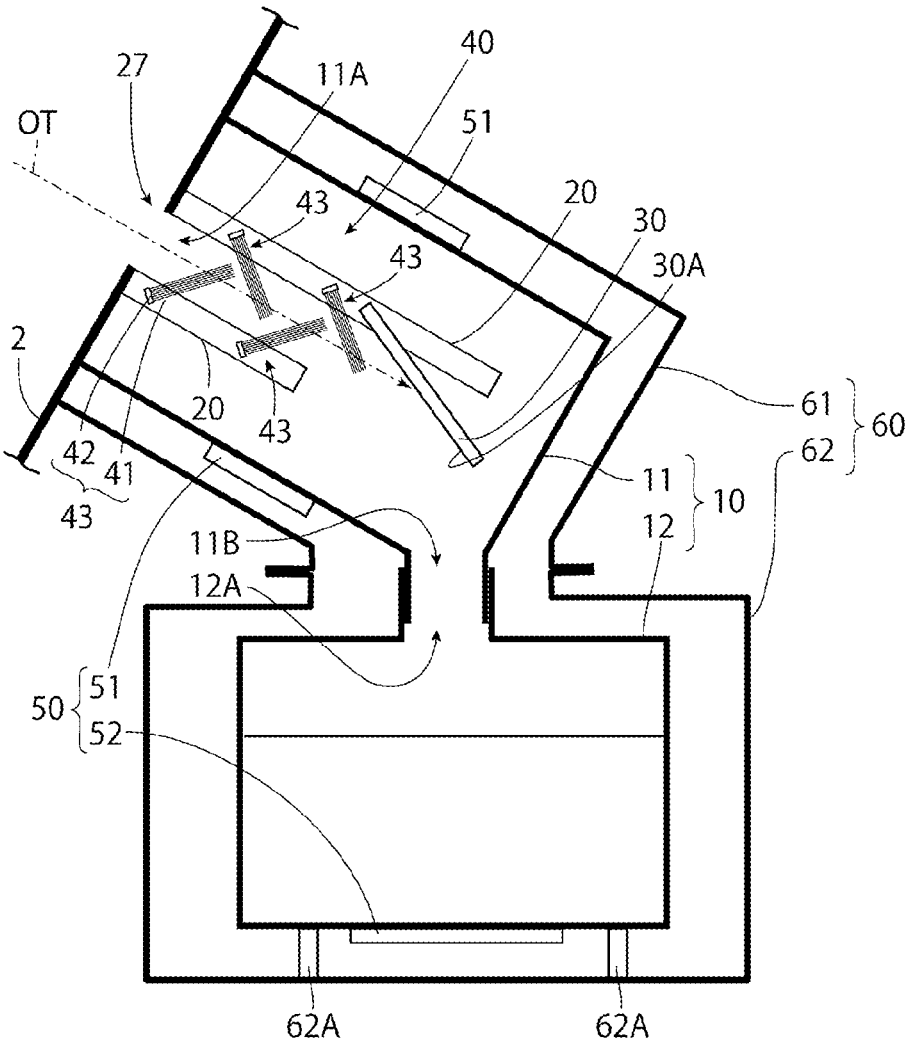
FIG. 2 is a schematic view of an outline configuration example of a droplet collection device.

As illustrated in FIG. 2, the droplet collection device of the comparative example includes a collecting container 10, a holder frame 20, a collision plate 30, a buffer member 40, a heater 50, and a covering case 60.

The collecting container 10 is a container configured to collect the droplet DL not converted into the plasma in the plasma generation region AR, and is arranged on an outer wall surface side of the wall of the chamber 2. Moreover, the collecting container 10 is a container which can be sealed and depressurized, and the inside of the collecting container 10 communicates with the inside of the chamber 2 through an opening 27 provided at the wall of the chamber 2. The collecting container 10 may be molded integrally with the chamber 2, or may be formed separately from the chamber 2 and may be fixed to the chamber 2 with a predetermined fixture.

For example, the collecting container 10 may include an absorber portion 11 and a tank portion 12. The absorber portion 11 is a container portion configured to mitigate collision due to collision of the droplet DL supplied from the opening 27 of the chamber 2. The tank portion 12 is a container portion configured to store small droplets of the droplet DL crushed due to collision of the droplet DL.

The absorber portion 11 has an inlet-side opening 11A and an outlet-side opening 11B. The inlet-side opening 11A is provided on the trajectory OT of the droplet DL, and faces the opening 27 of the chamber 2. The outlet-side opening 11B is positioned on the lowermost side on the opposite side of the opening 27 of the chamber 2, and is formed, for example, in a tubular shape. The tank portion 12 has an opening 12A at an upper position in a case where the tank portion 12 is placed, and is formed, for example, in a tubular shape.

The outlet-side opening 11B of the absorber portion 11 is formed capable of being inserted and fitted in the opening 12A of the tank portion 12. In a case where the outlet-side opening 11B of the absorber portion 11 is fitted in the opening 12A of the tank portion 12, an internal space of the absorber portion 11 and an internal space of the tank portion 12 communicate with each other. Note that a fitting portion between the opening 11B and the opening 12A may be sealed. Alternatively, the absorber portion 11 and the tank portion 12 may be formed integrally such that the internal space of the absorber portion 11 and the internal space of the tank portion 12 communicate with each other. Alternatively, one or both of inner and outer wall surfaces of the absorber portion 11 and the tank portion 12 may be covered with a coating such as silicon carbide (SiC).

The holder frame 20 is a frame member configured to hold the collision plate 30 and the buffer member 40. For example, the holder frame 20 includes a rectangular plate-shaped member, and is arranged along the trajectory OT of the droplet DL with a predetermined distance from the trajectory OT. The holder frame 20 is fixed to, e.g., a wall of the absorber portion 11.

The collision plate 30 is a member provided in the absorber portion 11 of the collecting container 10 and configured to cause the droplet DL supplied from the opening 27 of the chamber 2 to the collecting container 10 to collide with the collision plate 30. The collision plate 30 is arranged inclined with respect to the trajectory OT of the droplet DL in a direction away from the opening 27 of the chamber 2, and is fixed to the holder frame 20. Of the collision plate 30, a collision surface 30A as a surface targeted for collision with the droplet DL faces the outlet-side opening 11B of the absorber portion 11. A material of the collision plate 30 includes alloy such as SUS.

The buffer member 40 is a member configured to mitigate impact of the droplet DL colliding with the collision plate 30. For example, the buffer member 40 has one or more wire rod bundles 43 obtained in such a manner that multiple wire rods 41 are bundled with the wire rods 41 being fixed to a fixture 42.

The wire rod 41 and the fixture 42 are made of materials exhibiting high thermal conductivity and being less chemically reactive with the droplet DL. Specifically, for example, the fixture 42 is made of alloy such as SUS, and the wire rod 41 is made of carbon exhibiting higher thermal conductivity than that of the fixture 42.

Figure 3:
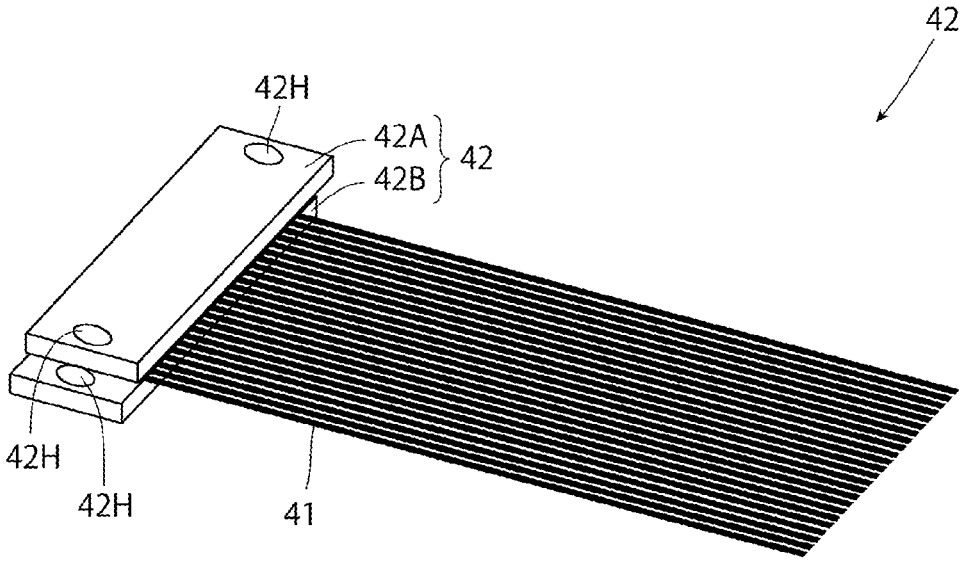
FIG. 3 is a perspective view of an outline configuration example of a wire rod bundle in a comparative example.
Figure 4:
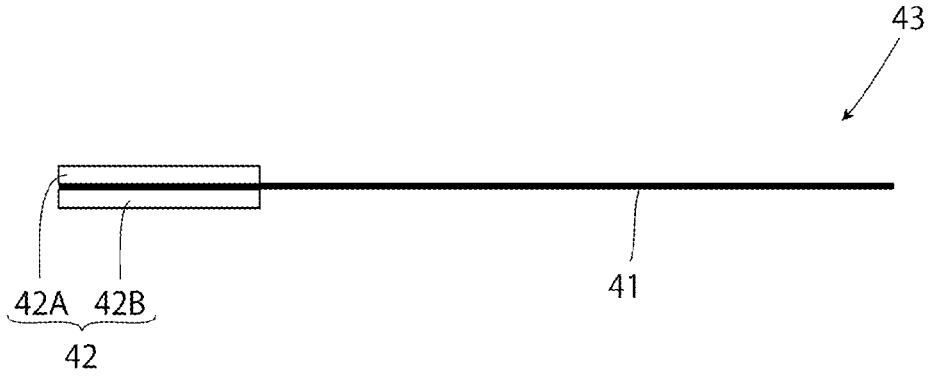
FIG. 4 is a side view of a state when the wire rod bundle of FIG. 3 is viewed from a wire rod arrangement direction.

As illustrated in FIGS. 3 and 4, the wire rods 41 are arranged along a direction perpendicular to a longitudinal direction of the wire rod 41. The fixture 42 includes a pair of plate members 42A and 42B, and bolts and nuts (not shown). A pair of through-holes 42H, into which the bolts can be inserted, are provided at end portions of each of the plate member 42A and 42B in a longitudinal direction thereof. In a state in which each wire rod 41 is arranged between the through-holes 42H and an end portion of such a wire rod 41 is sandwiched between the plate members 42A and 42B, the wire rods 41 and the pair of plate members 42A and 42B are fastened with the bolts and the nuts. In this manner, the wire rod bundle 43 is obtained.

One end side of the wire rod bundle 43 is arranged at the holder frame 20, and is fixed to the holder frame 20 through the fixture 42 of the wire rod bundle 43. The other end side of the wire rod bundle 43 is not fixed to the holder frame 20, and therefore, is a free end. Moreover, the other end side of the wire rod bundle 43 has a portion positioned on the trajectory OT of the droplet DL. The wire rod bundles 43 are inclined with respect to the trajectory OT of the droplet DL, and are each arranged such that the free end side of each wire rod 41 of the wire rod bundles 43 is away from the opening 27 of the chamber 2.

In a case where the buffer member 40 includes the wire rod bundles 43, the wire rod bundles 43 are fixed at different positions of the holder frame 20, and are different from each other in direction in which the wire rods 41 of the wire rod bundle 43 extend. For example, as illustrated in FIG. 2, the wire rod bundles 43 are arranged alternately on one side and the other side with respect to a boundary which is a plane including the trajectory OT of the droplet DL. As in the collision plate 30, one of the wire rod bundles 43 closest to the collision plate 30 faces the outlet-side opening 11B of the absorber portion 11. Note that the plane including the trajectory OT is a plane perpendicular to the plane of paper in an example illustrated in FIG. 2. However, as long as the plane is a reference indicating the boundary, the plane is not necessarily perpendicular to the plane of paper.

The heater 50 is configured to heat the collecting container 10 such that the internal temperature of the collecting container 10 reaches equal to or higher than the melting point of the droplet DL. For example, the heater 50 may include an absorber heater 51 provided at an outer wall of the absorber portion 11 of the collecting container 10, and a tank heater 52 provided at an outer wall of the tank portion 12 of the collecting container 10.

The covering case 60 is a case configured to cover the collecting container 10 with a space. For example, the covering case 60 may include an absorber case 61 configured to cover the absorber portion 11 of the collecting container 10, and a tank case 62 configured to cover the tank portion 12 of the collecting container 10. The absorber case 61 and the tank case 62 may be configured separatable from each other, or may be integrated. The covering case 60 suppresses release of heat to the atmosphere, the heat being generated from the heater 50 attached to the collecting container 10. Thus, a heating efficiency by the heater 50 is improved. Note that a tank holder 62A may be provided at the tank case 62.

3.2 Operation

When the heater 50 is driven, a wall surface of the collecting container 10 is held at equal to or higher than the melting point of the droplet DL by the heater 50. For example, in a case where the material of the droplet DL is tin, a set temperature at the heater 50 is set within a range of 240° C. to 400° C. In a case where this set temperature is set at 370° C. and the wire rods 41 of each wire rod bundle 43 are formed from carbon fibers, the temperature of the wall surface of the collecting container 10 is held at approximately 370° C., and the wire rods 41 arranged in the collecting container 10 are at approximately 290° C. In this state, the wire rods 41 arranged in the collecting container 10 are heated by heat transfer from the fixture 42 through the holder frame 20 and radiation from the absorber portion 11.

Figure 5:
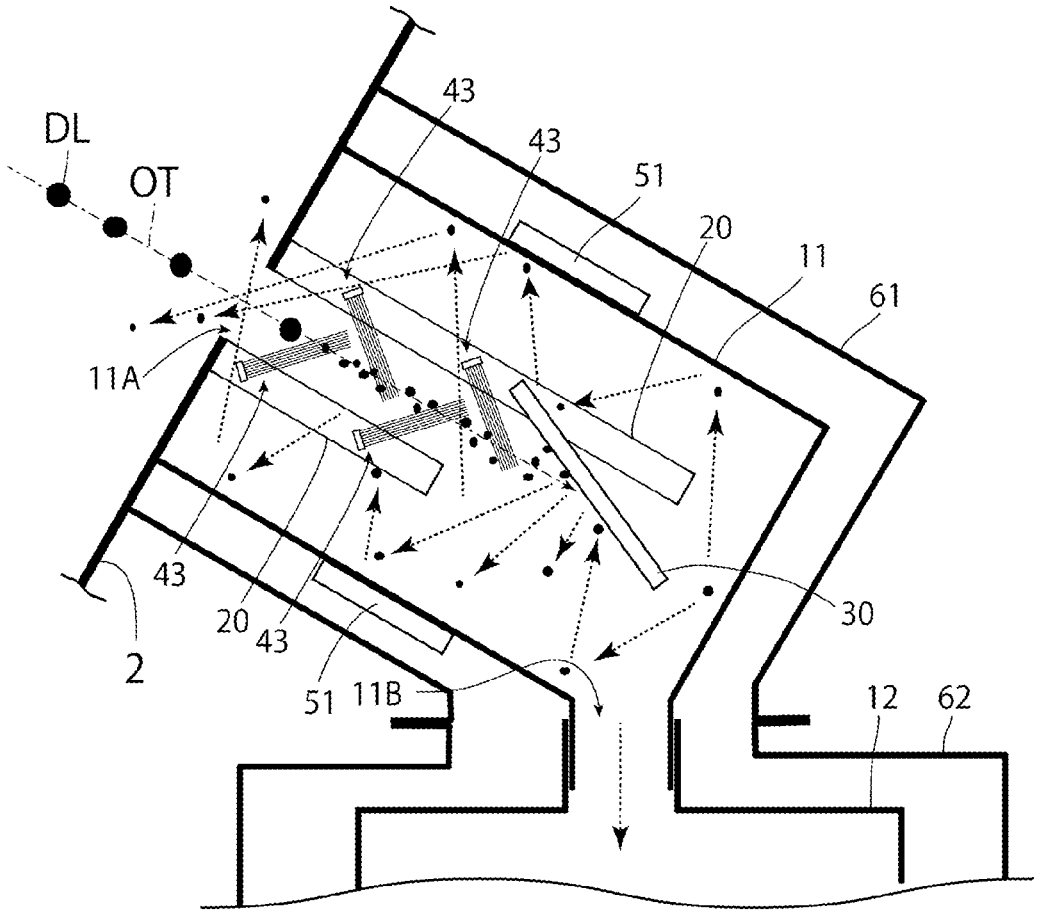
FIG. 5 is a view of a state when a droplet is collected by the droplet collection device.

The droplet DL with a speed of, e.g., about 30 to 120 m/s is supplied to the collecting container 10 held at a temperature equal to or higher than the melting point of the droplet DL. As illustrated in FIG. 5, the droplet DL having entered the absorber portion 11 through the inlet-side opening 11A of the absorber portion 11 comes into collision with the wire rods 41 of the wire rod bundle 43. The droplet DL collides with the wire rods 41, and therefore, motion energy of the droplet DL decreases. Thus, impact upon collision of the droplet DL with the collision plate 30 is mitigated. In a case where there are two or more wire rod bundles 43, the number of times of passage through the wire rod bundle 43 increases as the droplet DL travels toward a terminal end side of the trajectory OT of the droplet DL. In this case, the motion energy of the droplet DL decreases as the droplet DL travels toward the terminal end side of the trajectory OT.

The droplet DL colliding with the wire rods 41 of the wire rod bundle 43 is crushed into small droplets, and these small droplets travel while dispersing to the periphery of the trajectory OT of the droplet DL. In a case where there are two or more wire rod bundles 43, the number of times of passage through the wire rod bundle 43 increases as the droplet DL travels toward the terminal end side of the trajectory OT of the droplet DL. In this case, the droplet DL is more finely crushed as the droplet DL travels toward the terminal end side of the trajectory OT.

The small droplets with smaller motion energy collide with the collision plate 30, and therefore, become finer. Part of these droplets drop into the tank portion 12 through the outlet-side opening 11B of the absorber portion 11. The wire rod bundles 43 and the collision plate 30 of the absorber portion 11 are arranged on a traveling path of the droplet DL until the tank portion 12. Thus, as compared to a case where the droplet DL directly travels into the tank portion 12, scattering of the small droplets from the tank portion 12 is reduced.

3.3 Disadvantage

As described above, in the wire rod bundle 43, the wire rods 41 arranged between the plate member 42A and the plate member 42B are fixed in such a manner that both end portions of the pair of plate members 42A and 42B in the longitudinal direction are fastened.

Figure 6:
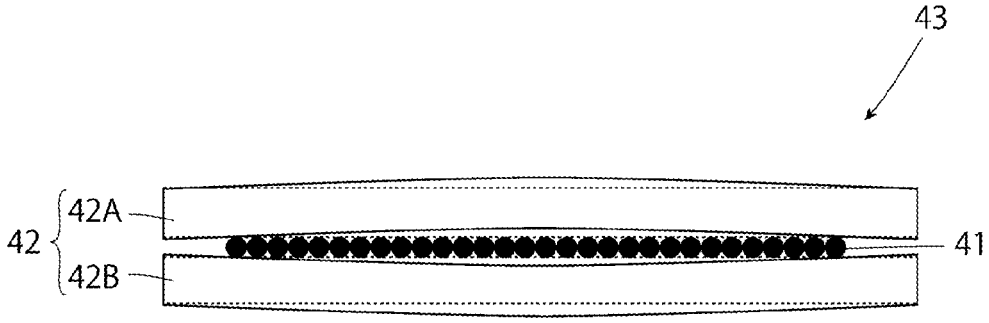
FIG. 6 is a side view of a state when the wire rod bundle of FIG. 3 is viewed from one end side of a wire rod.

Thus, as illustrated in FIG. 6, center portions of the pair of plate members 42A and 42B warp apart from each other due to fastening of both end portions of the plate members 42A and 42B, and the force of fixing the wire rods 41 at such warped portions is weakened. For this reason, tendency shows that a disadvantage that the wire rods 41 are dispersed or dropped from the plate members 42A and 42B due to, e.g., collision of the droplet DL supplied to the collecting container 10 is easily caused.

Due to such a disadvantage, the droplet DL supplied to the collecting container 10 collides with the collision plate 30 without contacting the wire rods 41, and therefore, the motion energy of the small droplets scattering in the absorber portion 11 increases. Thus, the probability of dispersing some of these small droplets from the absorber portion 11 to the chamber 2 increases.

In a case where the small droplets are diffused to the chamber 2, these small droplets react with the etching gas, or are discharged by the exhaust device 6 in an unreacted state. However, there is a concern that the small droplets diffused from the absorber portion 11 to the chamber 2 adhere to the light focusing mirror 23 etc. without being discharged by the exhaust device 6, and the output of the EUV light EL decreases or no EUV light EL is generated.

For this reason, in the embodiments below, the droplet collection device configured so that diffusion of the small droplets of the droplet DL to the chamber 2 can be reduced will be described as an example.

4. First Embodiment 4.1 Partial Configuration in Droplet Collection Device

Next, a partial configuration in a droplet collection device will be described as a first embodiment. Note that the same reference signs are used to represent configurations similar to those described above, and unless otherwise stated, overlapping description is omitted.

Figure 7:
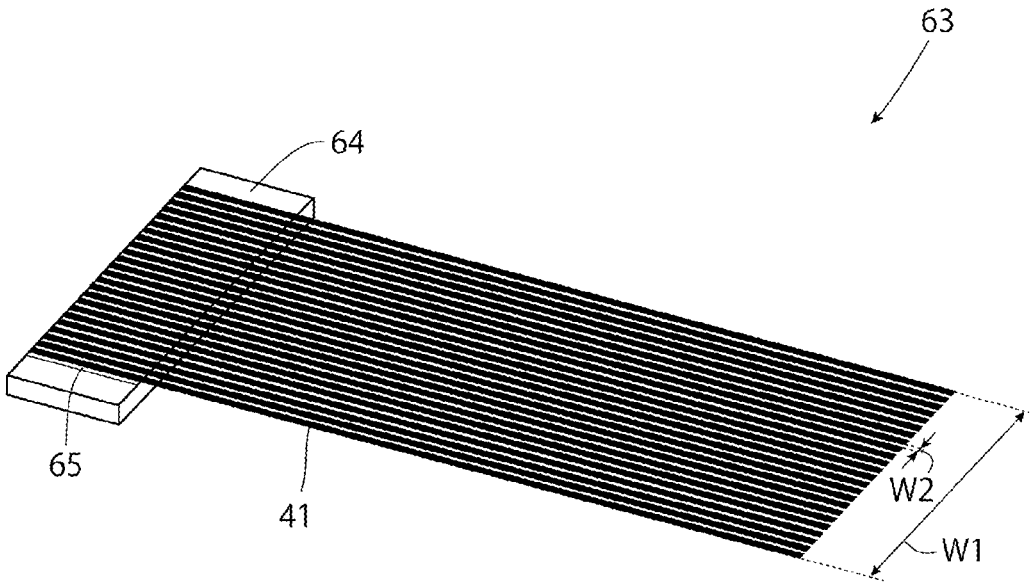
FIG. 7 is a perspective view of an outline configuration example of a wire rod bundle in a first embodiment.
Figure 8:
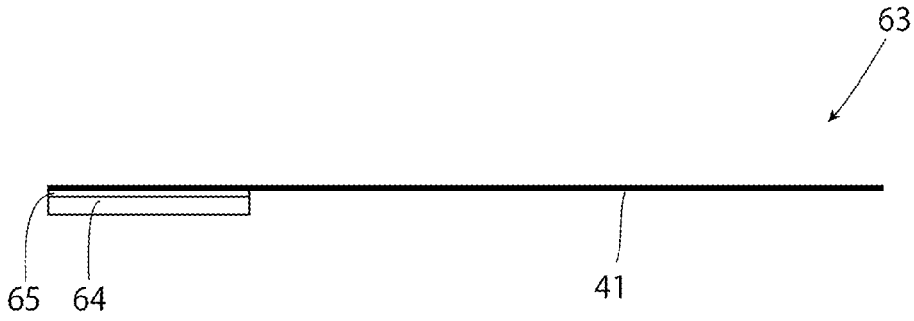
FIG. 8 is a side view of a state when the wire rod bundle of FIG. 7 is viewed from a wire rod arrangement direction.

As illustrated in FIGS. 7 and 8, in the droplet collection device of the present embodiment, a wire rod bundle 63 having a configuration different from that of the wire rod bundle 43 of the comparative example is employed instead of the wire rod bundle 43. The wire rod bundle 63 is bundled such that multiple wire rods 41 made of carbon are fixed to a graphite plate 64 with an adhesive 65.

The graphite plate 64 is a plate member made of graphite, and is, for example, in a rectangular parallelepiped shape. The wire rods 41 are arranged along a longitudinal direction of the graphite plate 64. For example, in a case where a wire rod width W1 as a distance between the wire rods positioned at both ends in a direction in which the wire rods 41 are arranged is 25 mm, 12000 wire rods 41 are arranged within the area of the wire rod width. Moreover, widths W2 between mutually adjacent ones of the wire rods are substantially equal to each other. One-side end portions of the wire rods 41 arranged as described above are arranged on one surface side of the graphite plate 64. Of surfaces of the graphite plate 64, at least surfaces other than a portion where the adhesive 65 is arranged may be covered with, e.g., a coating of SiC (silicon carbide).

The adhesive 65 is obtained as graphitized phenol resin in such a manner that the wire rods 41 and the graphite plate 64 are baked after having been joined by phenol resin. The adhesive 65 joins the wire rods 41 and the graphite plate 64 in a carbon composite state.

4.2 Feature/Advantageous Effect

Figure 9:
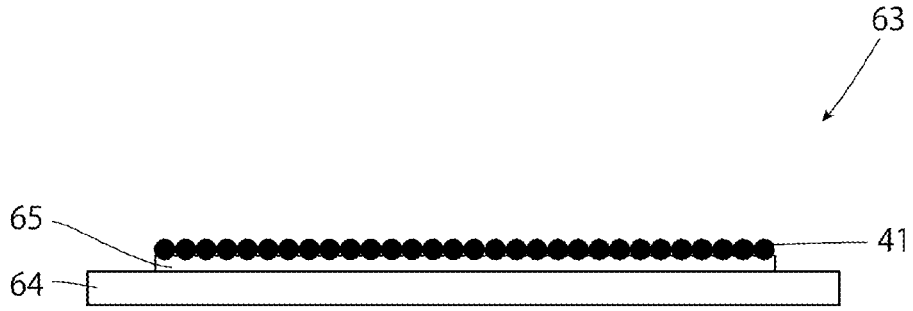
FIG. 9 is a side view of a state when the wire rod bundle of FIG. 7 is viewed from one end side of a wire rod.

As described above, in the wire rod bundle 63 of the present embodiment, the wire rods 41 are fixed to the graphite plate 64 with the graphitized adhesive 65 in a state in which the wire rods 41 are arranged in one direction. Thus, as illustrated in FIG. 9, the wire rods 41 made of carbon and the graphite plate 64 as the plate member made of graphite are integrally joined together with the adhesive 65. This eliminates partial weakening of the force of fixing the wire rods 41.

Thus, a disadvantage that the wire rods 41 are dispersed or dropped from the graphite plate 64 due to, e.g., collision of a droplet DL supplied to a collecting container 10 is suppressed. Thus, since the droplet DL supplied to the collecting container 10 collides with the collision plate 30 without contacting with the wire rods 41, motion energy of small droplets scattering in an absorber portion 11 can be prevented from increasing. As a result, in the droplet collection device of the present embodiment, diffusion of the small droplets of the droplet DL from the absorber portion 11 to a chamber 2 is reduced.

5. Second Embodiment 5.1 Partial Configuration in Droplet Collection Device

Next, a partial configuration in a droplet collection device will be described as a second embodiment. Note that the same reference signs are used to represent configurations similar to those described above, and unless otherwise stated, overlapping description is omitted.

Figure 10:
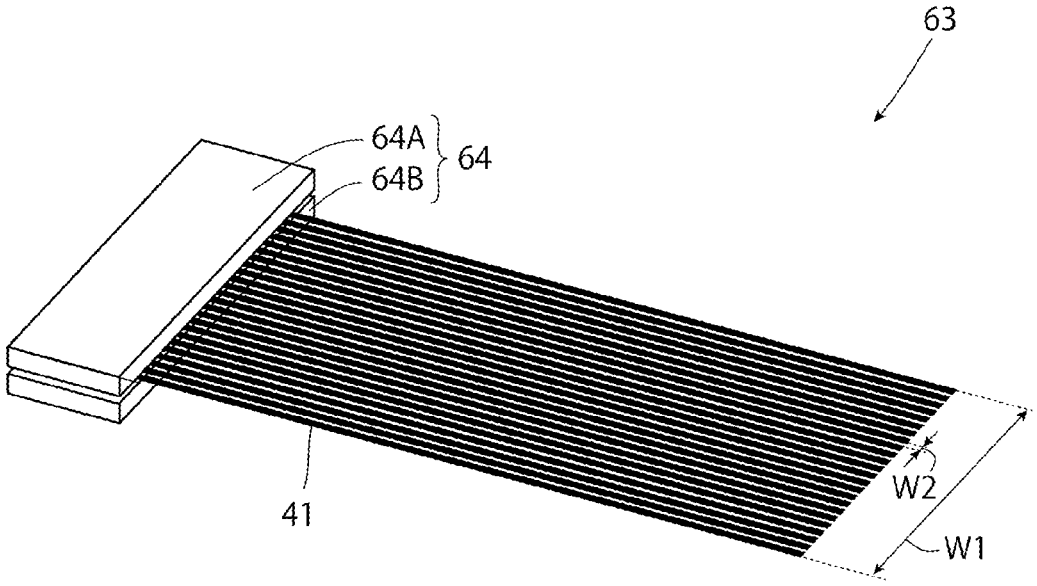
FIG. 10 is a perspective view of an outline configuration example of a wire rod bundle in a second embodiment.
Figure 11:
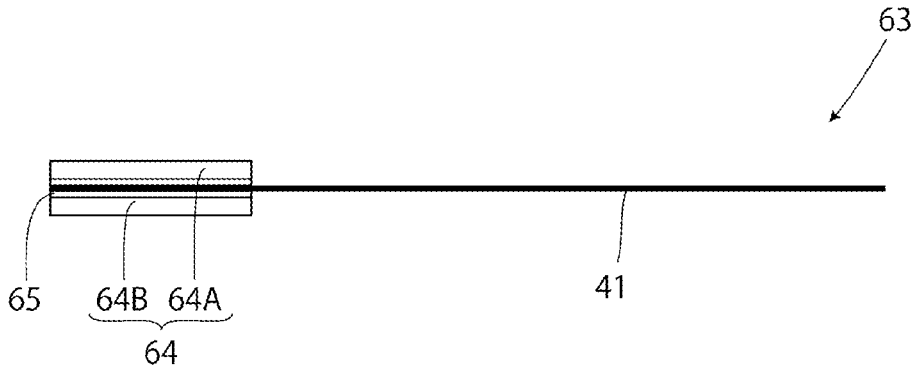
FIG. 11 is a side view of a state when the wire rod bundle of FIG. 10 is viewed from a wire rod arrangement direction.

As illustrated in FIGS. 10 and 11, in the droplet collection device of the present embodiment, the graphite plate 64 of the wire rod bundle 63 of the first embodiment includes a first plate member 64A and a second plate member 64B.

Both of the first plate member 64A and the second plate member 64B may be made of graphite, and may have, for example, the same shape and the same size. Of surfaces of the first plate member 64A and the second plate member 64B, at least surfaces other than a portion where an adhesive 65 is arranged may be covered with a coating of, e.g., SiC (silicon carbide).

One-side end portions of multiple wire rods 41 are arranged between the first plate member 64A and the second plate member 64B, and the wire rods 41 are fixed to the first plate member 64A and the second plate member 64B with the adhesive 65.

5.2 Feature/Advantageous Effect

Figure 12:
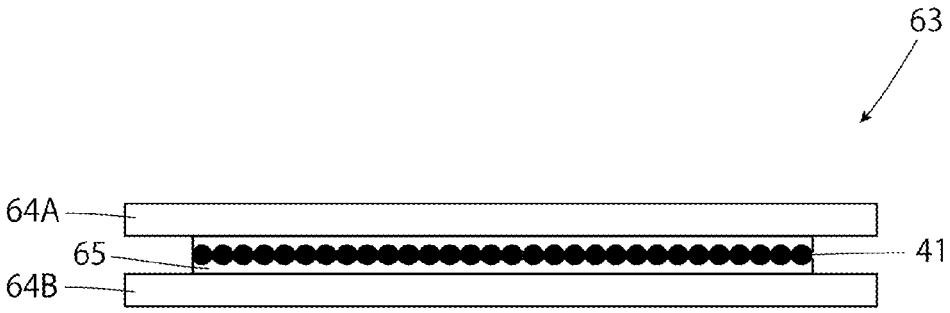
FIG. 12 is a side view of a state when the wire rod bundle of FIG. 11 is viewed from one end side of a wire rod.

As described above, in the wire rod bundle 63 of the present embodiment, the wire rods 41 are fixed with the graphitized adhesive 65 with the wire rods 41 being sandwiched between the first plate member 64A and the second plate member 64B as illustrated in FIG. 12. Thus, as compared to the case of the first embodiment described above, the wire rod bundle 63 of the present embodiment can more stably hold the wire rods 41 because the wire rods 41 are fixed to both of the first plate member 64A and the second plate member 64B with the wire rods 41 being sandwiched between the first plate member 64A and the second plate member 64B. The wire rod bundle 63 of the present embodiment can also stably hold the wire rods 41 even when the wire rods 41 are stacked on each other in a thickness direction of the first plate member 64A and the second plate member 64B. This easily leads to a higher density.

6. Third Embodiment 6.1 Partial Configuration in Droplet Collection Device

Next, a partial configuration in a droplet collection device will be described as a third embodiment. Note that the same reference signs are used to represent configurations similar to those described above, and unless otherwise stated, overlapping description is omitted.

Figure 13:
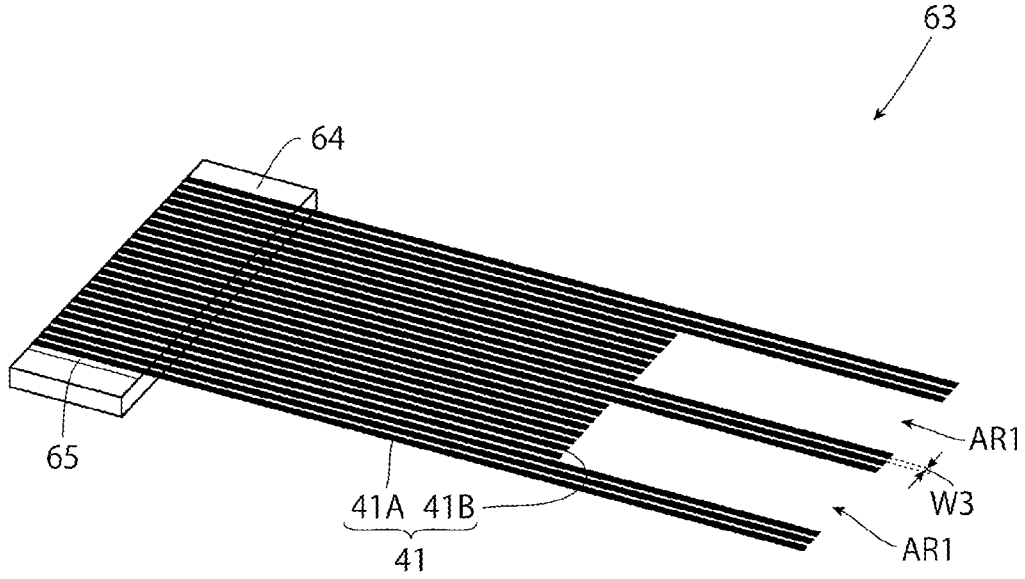
FIG. 13 is a perspective view of an outline configuration example of a wire rod bundle in a third embodiment.

As illustrated in FIG. 13, in the droplet collection device of the present embodiment, spaces AR1 having a greater width than a width W3 between wire rods closest to each other are provided between wire rods positioned at both ends in a direction in which multiple wire rods 41 are arranged.

In the case of the present embodiment, the wire rods 41 include first wire rods 41A and second wire rods 41B shorter than the first wire rod 41A, and the second wire rods 41B are arranged between the first wire rods 41A. Note that in the case of the present embodiment, a space between adjacent ones of the first wire rods 41A, a space between adjacent ones of the second wire rods 41B, and a space between the first wire rod 41A and the second wire rod 41B are substantially equal.

The second wire rod 41B is obtained by cutting, for example, the first wire rod 41A. Note that the second wire rods 41B obtained in advance may be fixed to a graphite plate 64 with an adhesive 65, or the second wire rods 41B may be obtained in such a manner that part of the first wire rods 41A fixed to the graphite plate 64 with the adhesive 65 is cut.

In the present embodiment, the space AR1 surrounded by the first wire rods 41A and the second wire rods 41B is provided on a free end side opposite to a fixed end side of the first wire rods 41A and the second wire rods 41B. The first wire rods 41A and the second wire rods 41B may be arrayed in such a positional relationship that two spaces AR1 are line-symmetrical with respect to a boundary which is the first wire rods 41A positioned at the center in a wire rod width.

Note that the number of second wire rods 41B arranged between the first wire rods 41A may be one, or may be two or more. In a case where the number of second wire rods 41B arranged between the first wire rods 41A is two or more, the second wire rods 41B may have the same length or different lengths. As in the second embodiment, the graphite plate 64 in a wire rod bundle 63 of the present embodiment may include a first plate member 64A and a second plate member 64B, and the first wire rods 41A and the second wire rods 41B may be fixed with the adhesive 65 with the first wire rods 41A and the second wire rods 41B being sandwiched between the first plate member 64A and the second plate member 64B.

6.2 Feature/Advantageous Effect

As described above, in the wire rod bundle 63 of the present embodiment, the spaces AR1 each surrounded by the first wire rods 41A and the second wire rods 41B shorter than the first wire rod 41A are provided between the wire rods positioned at both ends in the direction in which the wire rods 41 are arranged. Depending on, e.g., the length of the second wire rod 41B or the number of arranged second wire rods 41B, for example, the degree of decreasing motion energy of a droplet DL upon collision with the wire rod 41 can be finely adjusted. In the case of an extremely-high density of the wire rods 41, the droplet DL or small droplets thereof might adhere to the wire rods 41, and might be accumulated. In the wire rod bundle 63 of the present embodiment, the density of the wire rods 41 is adjusted so that accumulation of the droplet DL or the small droplets thereof can be reduced.

Note that the wire rods 41 can be firmly fixed to the graphite plate 64 with the adhesive 65, and therefore, processing such as cutting of part of the first wire rods 41A fixed to the graphite plate 64 with the adhesive 65 can be performed. Thus, the shape or size of the space AR1 can be easily changed, and therefore, the density of the wire rods 41 between the wire rods positioned at both ends in the direction in which the wire rods 41 are arranged is easily adjusted.

7. Fourth Embodiment 7.1 Partial Configuration in Droplet Collection Device

Next, a partial configuration in a droplet collection device will be described as a fourth embodiment. Note that the same reference signs are used to represent configurations similar to those described above, and unless otherwise stated, overlapping description is omitted.

Figure 14:
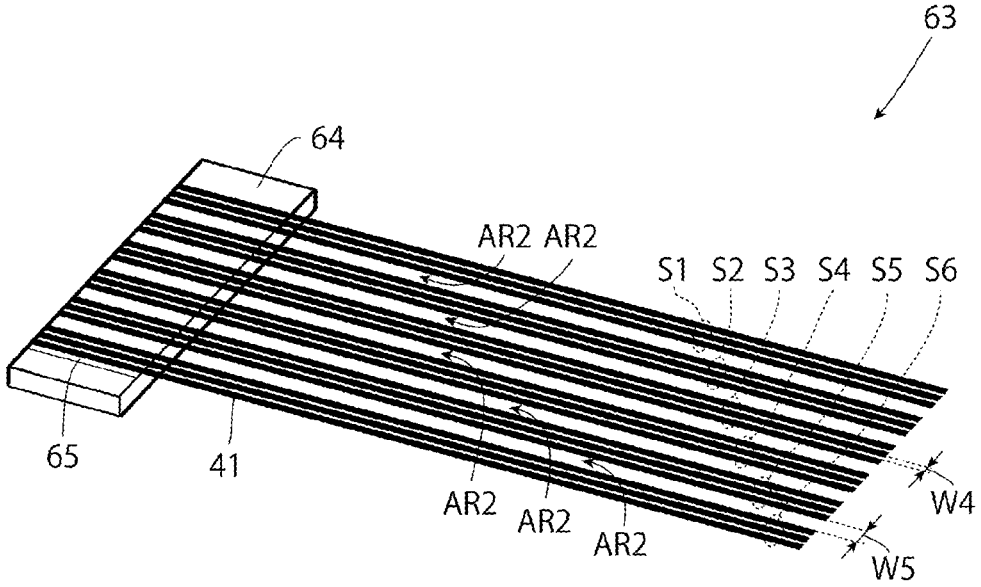
FIG. 14 is a perspective view of an outline configuration example of a wire rod bundle in a fourth embodiment.

As illustrated in FIG. 14, in the droplet collection device of the present embodiment, spaces AR2 having a greater width than a width W4 between wire rods closest to each other are provided between wire rods positioned at both ends in a direction in which multiple wire rods 41 are arranged.

In the case of the present embodiment, the wire rods 41 are divided into multiple groups S1 to S6. A width W5 between adjacent ones of the groups is greater than the width W4 between adjacent ones of the wire rods of the wire rods 41 forming this group. For example, the groups S1 to S6 may be arrayed at equal intervals such that the spaces AR2 each surrounded by adjacent ones of the groups have the substantially equal size.

Note that a clearance between adjacent ones of the wire rods forming the group S1, S2, S3, S4, S5, or S6 may be the same or different. Alternatively, the number of wire rods forming the group may be the same or different among the groups S1 to S6. Alternatively, as in the second embodiment, a graphite plate 64 in a wire rod bundle 63 of the present embodiment may include a first plate member 64A and a second plate member 64B, and each wire rod 41 may be fixed with an adhesive 65 with each wire rod 41 being sandwiched between the first plate member 64A and the second plate member 64B.

7.2 Feature/Advantageous Effect

As described above, in the wire rod bundle 63 of the present embodiment, the wire rods 41 are divided into the groups. The width W5 between adjacent ones of the groups is greater than the width W4 between adjacent ones of the wire rods. The space AR2 is provided between adjacent ones of the groups between the wire rods positioned at both ends in the direction in which the wire rods 41 are arranged. Depending on the width W5 between the groups, for example, the degree of decreasing motion energy of a droplet DL upon collision with the wire rod 41 can be finely adjusted.

Note that the fourth embodiment may be combined with the third embodiment described above. For example, the groups S1 to S6 may include groups of first wire rods 41A and groups of second wire rods 41B shorter than the first wire rod 41A, and these groups are alternately arranged. Thus, the fourth embodiment and the third embodiment can be combined together. Further, for example, in a case where each of multiple wire rod bundles 43 (FIG. 2) arranged at different positions on a trajectory OT of the droplet DL is changed to the wire rod bundle 63 of the present embodiment, the width W5 between the groups in each wire rod bundle 63 may be narrowed or expanded toward a terminal end side of the trajectory OT.

8. Fifth Embodiment 8.1 Partial Configuration in Droplet Collection Device

Next, a partial configuration in a droplet collection device will be described as a fifth embodiment. Note that the same reference signs are used to represent configurations similar to those described above, and unless otherwise stated, overlapping description is omitted.

Figure 15:
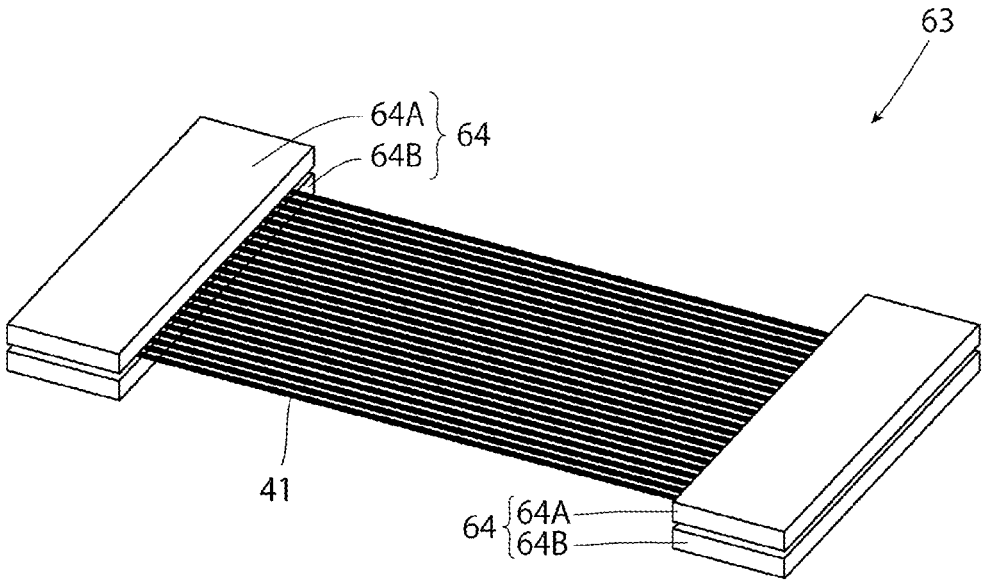
FIG. 15 is a perspective view of an outline configuration example of a wire rod bundle in a fifth embodiment.

As illustrated in FIG. 15, in the droplet collection device of the present embodiment, a graphite plate 64 in a wire rod bundle 63 includes, as in the second embodiment, a first plate member 64A and a second plate member 64B.

Moreover, end portions of multiple wire rods 41 on one end side are fixed to the first plate member 64A and the second plate member 64B, and end portions of the wire rods 41 on the other end side are fixed to the other first plate member 64A and the other second plate member 64B.

One end side of the wire rod bundle 63 as described above is arranged at a holder frame 20 (FIG. 2), and is fixed to the holder frame 20 through the first plate member 64A and the second plate member 64B of the wire rod bundle 63. Moreover, the other end side of the wire rod bundle 63 is arranged at a holder frame 20 (FIG. 2) on the opposite side of the holder frame 20 to which one end side of the wire rod bundle 63 is fixed, and is fixed to the holder frame 20 through the other first plate member 64A and the other second plate member 64B of the wire rod bundle 63.

Note that one of the first plate members 64A and the second plate members 64B at both end portions of the wire rods 41 may be omitted.

8.2 Feature/Advantageous Effect

As described above, in the wire rod bundle 63 of the present embodiment, both end portions of the wire rods 41 are fixed with an adhesive 65 with such an end portion being sandwiched between the first plate member 64A and the second plate member 64B. Thus, as compared to a case where only one-side end portions of the wire rods 41 are fixed as in the second embodiment, disassembly of the end portions of the wire rods 41 due to collision of a droplet DL is avoided.

Moreover, in the case of the present embodiment, both end portions of the wire rod bundle 63 are fixed to the holder frames 20. Thus, as compared to a case where only one-side end portion of the wire rod bundle 63 is fixed to the holder frame 20, the wire rod bundle 63 can be more firmly fixed, and durability against collision of the droplet DL can be improved. Note that as compared to a case where only one-side end portion of the wire rod bundle 63 is fixed to the holder frame 20, the degree of freedom in layout of the wire rod bundle 63, such as an angle with respect to a trajectory OT of the droplet DL, is easily improved.

9. Sixth Embodiment

9.1 Partial Configuration in Droplet Collection Device

Next, a partial configuration in a droplet collection device will be described as a sixth embodiment. Note that the same reference signs are used to represent configurations similar to those described above, and unless otherwise stated, overlapping description is omitted.

Figure 16:
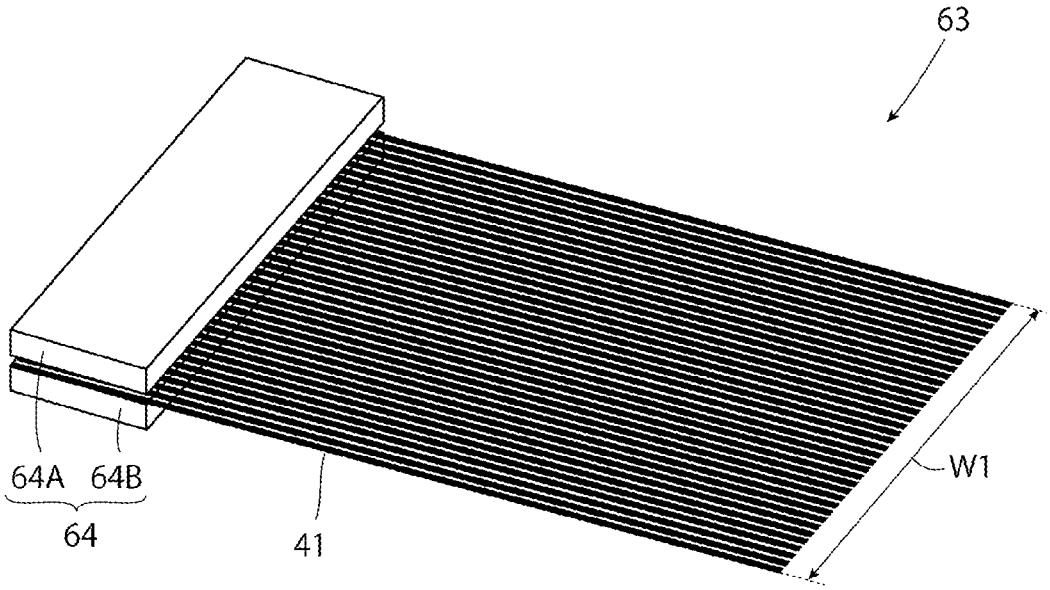
FIG. 16 is a perspective view of an outline configuration example of a wire rod bundle in a sixth embodiment.

As illustrated in FIG. 16, in the droplet collection device of the present embodiment, a wire rod width W1 in a wire rod bundle 63 is greater than that in the second embodiment. Note that one of a first plate member 64A and a second plate member 64B in the present embodiment may be omitted.

9.2 Feature/Advantageous Effect

Wire rods 41 can be firmly fixed to a graphite plate 64 with an adhesive 65, and therefore, instability of the wire rods 41 is eliminated even when the wire rod width W1 is expanded as in the wire rod bundle 63 of the present embodiment.

Note that in a case where each of multiple wire rod bundles 43 (FIG. 2) arranged at different positions on a trajectory OT of a droplet DL is changed to the wire rod bundle 63 of the present embodiment, the wire rod width W1 in each wire rod bundle 63 may be increased toward a terminal end side of the trajectory OT.

10. Seventh Embodiment

10.1 Partial Configuration in Droplet Collection Device

Next, a partial configuration in a droplet collection device will be described as a seventh embodiment. Note that the same reference signs are used to represent configurations similar to those described above, and unless otherwise stated, overlapping description is omitted.

Figure 17:
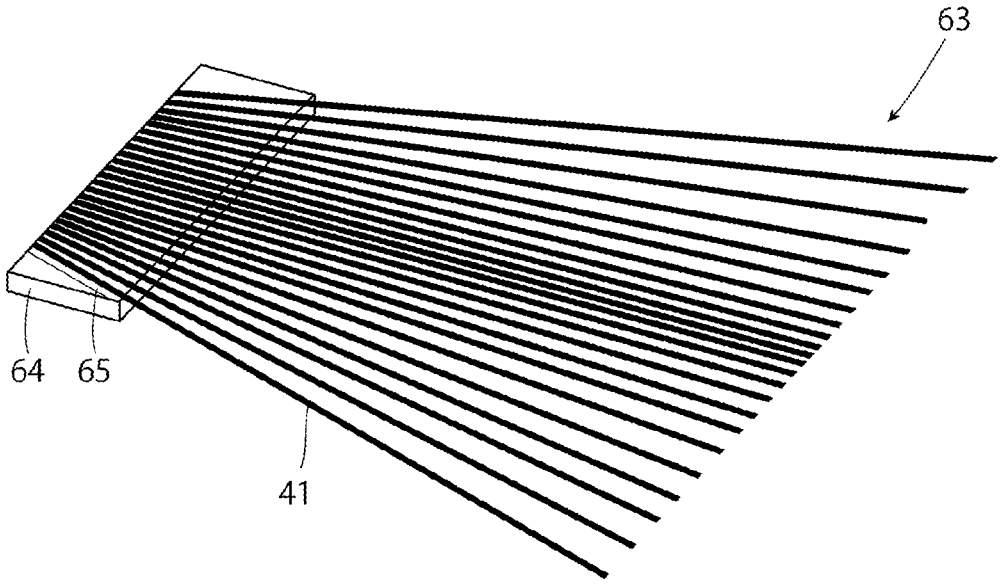
FIG. 17 is a perspective view of an outline configuration example of a wire rod bundle in a seventh embodiment.

As illustrated in FIG. 17, in the droplet collection device of the present embodiment, multiple wire rods 41 in the wire rod bundle 63 of the first embodiment are arranged in such a fan shape that a space between the wire rods is expanded toward an end portion opposite to one-side end portion as a fixed end of each wire rod 41. Note that a graphite plate 64 in the wire rod bundle 63 of the present embodiment may include, as in the second embodiment, a first plate member 64A and a second plate member 64B, and the wire rods 41 may be fixed with an adhesive 65 with the wire rods 41 being sandwiched between the first plate member 64A and the second plate member 64B.

10.2 Feature/Advantageous Effect

The wire rods 41 can be firmly fixed to the graphite plate 64 with the adhesive 65, and therefore, the degree of freedom in arrangement of the wire rods 41 is improved as in the wire rod bundle 63 of the present embodiment.

Description above is intended to provide mere examples without any limitations. Accordingly, it will be obvious to those skilled in the art that changes can be made to the embodiments and variations of the present disclosure without departing from the scope of the accompanying claims.

The terms used in the present specification and the entire scope of the accompanying claims should be construed as terms "without limitations". For example, a term "including" or "included" should be construed as "not limited to that described to include". A term "have" should be construed as "not limited to that described to have". Moreover, a modifier "a/an" described in the present specification and the accompanying claims should be construed to mean "at least one" or "one or more".

What is claimed is:

1. A droplet collection device comprising:

a collecting container arranged on an outer wall surface side of a wall of a chamber and configured to communicate with an inside of the chamber through an opening provided at the wall of the chamber;

a collision plate arranged in the collecting container and configured such that a droplet supplied from the opening to the collecting container is to collide with the collision plate; and a buffer member arranged on an opening side with respect to the collision plate and configured to mitigate impact of the droplet colliding with the collision plate, the buffer member having a wire rod bundle configured such that multiple wire rods are bundled and fixed to a plate member, the wire rods being made of carbon, and the plate member being made of graphite, the wire rods being fixed to the plate member with a graphitized adhesive with the wire rods arranged in one direction, a space having a greater width than a width between wire rods closest to each other is provided between wire rods positioned at both ends in a direction in which the wire rods are arranged, the wire rods include first wire rods and second wire rods shorter than the first wire rods, each second wire rod is arranged between the first wire rods, and the space is between adjacent ones of the first wire rods.

2. The droplet collection device according to claim 1, wherein the plate member includes a first plate member and a second plate member, and the wire rods are arranged between the first plate member and the second plate member, and are fixed to the first plate member and the second plate member with the graphitized adhesive.

3. The droplet collection device according to claim 1, wherein a surface of a portion of the plate member without the adhesive is covered with SiC.

4. The droplet collection device according to claim 1, wherein the collecting container communicates with the chamber to which a gas containing hydrogen is supplied via the opening.

* * * * *